US008241460B2

(12) United States Patent
Kida et al.

(10) Patent No.: US 8,241,460 B2
(45) Date of Patent: Aug. 14, 2012

(54) METHOD AND APPARATUS FOR MANUFACTURING CIGARETTE WRAPPING PAPER

(75) Inventors: Shinzo Kida, Tokyo (JP); Takafumi Izumiya, Tokyo (JP); Yuzuru Sakuma, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/336,040

(22) Filed: Dec. 23, 2011

(65) Prior Publication Data

US 2012/0090799 A1 Apr. 19, 2012

Related U.S. Application Data

(63) Continuation of application No. PCT/JP2009/062374, filed on Jul. 7, 2009.

(51) Int. Cl.
*D21H 27/00* (2006.01)
*D21H 27/02* (2006.01)
*D21H 23/22* (2006.01)

(52) U.S. Cl. ..... 162/139; 162/109; 162/158; 162/159; 162/184; 162/197; 162/202; 162/204; 162/265; 162/361; 131/365

(58) Field of Classification Search ..... 162/109, 162/139, 158, 159, 184, 187, 197, 202, 204, 162/265, 361; 131/365
See application file for complete search history.

(56) References Cited

U.S. PATENT DOCUMENTS

| | | | | |
|---|---|---|---|---|
| 4,853,255 | A * | 8/1989 | Onishi et al. | 427/148 |
| 5,474,095 | A | 12/1995 | Allen et al. | |
| 5,579,693 | A * | 12/1996 | Carreira et al. | 101/424.1 |
| 5,850,589 | A * | 12/1998 | Cruz et al. | 399/341 |
| 6,929,013 | B2 * | 8/2005 | Ashcraft et al. | 131/365 |
| 2003/0150466 | A1 | 8/2003 | Kitao et al. | |
| 2005/0241660 | A1 * | 11/2005 | Ashcraft et al. | 131/365 |
| 2007/0102017 | A1 * | 5/2007 | Sherwood et al. | 131/365 |
| 2010/0297351 | A1 * | 11/2010 | Kida et al. | 427/299 |

FOREIGN PATENT DOCUMENTS

| | | | |
|---|---|---|---|
| JP | 4-289298 | A | 10/1992 |
| JP | 2004-512849 | A | 4/2004 |
| JP | 2005-514939 | A | 5/2005 |
| WO | WO 02/19848 | A1 | 3/2002 |
| WO | WO 02/37991 | A1 | 5/2002 |
| WO | WO 03/061410 | A1 | 7/2003 |

* cited by examiner

*Primary Examiner* — Matthew Daniels
*Assistant Examiner* — Dennis Cordray
(74) *Attorney, Agent, or Firm* — Birch, Stewart, Kolasch & Birch, LLP

(57) ABSTRACT

Web to be formed into wrapping paper is applied with combustion inhibitor and then dried. Water is applied onto the entire surface of the opposite side to the combustion-inhibitor applied side of the web. The web applied with water is dried while pinched between drying and pressing rollers and stretched in a width direction. In this way, unwrinkled high-quality cigarette wrapping paper having a low ignition propensity can be stably and inexpensively manufactured. As the pressing roller, a heat-resistant rubber roller provided in its surface with a soft portion in a helical way is utilized.

17 Claims, 3 Drawing Sheets

METHOD AND APPARATUS FOR MANUFACTURING CIGARETTE WRAPPING PAPER

CROSS REFERENCE TO RELATED APPLICATIONS

This application is a Continuation of PCT/JP2009/062374 filed on Jul. 7, 2009, which is hereby expressly incorporated by reference into the present application.

TECHNICAL FIELD

The present invention relates to a method and apparatus for manufacturing cigarette wrapping paper with a low ignition propensity.

BACKGROUND ART

In recent years, there has been a development of a low ignition propensity cigarette that decreases the possibility of fire spreading to a burnable material if the cigarette is dropped onto the material while burning (see Patent Document 1 for example). A low ignition propensity cigarette of this type is fabricated by arranging at predetermined axial intervals a plurality of band layers 4 made of combustion inhibitor in wrapping paper 3 that wraps shred tobacco 1 into a rod-like shape to form a cigarette 2 as illustrated in FIG. 4, for example. FIG. 4 shows a so-called low ignition propensity cigarette with a filter, which is fabricated by attaching a filter 6 to an end of the cigarette 2 by using tip paper 5.

The wrapping paper 3 having the band layers 4 is produced by applying liquid combustion inhibitor (sodium alginate solution, for example) onto web during the running of the web that will turn into the wrapping paper 3 to form the band layers 4, and then drying the band layers 4 together with the web. More specifically, the band layers 4 extend along the entire circumference of the cigarette 2 in a band-like shape, and extend in a width direction of web W to have given width H, for example, as illustrated in FIG. 5 so as to be arranged at a predetermined pitch in an axial direction of the cigarette 2 in the form of band-like pattern that is repeatedly arranged at the pitch P.

In Patent Document 1, the quality of the wrapping paper 3 is secured by carrying out the application and drying of the combustion inhibitor more than one time. In other words, even if shrinkage may occur in the treated areas of the web applied with the combustion inhibitor, wrinkles resulting in the untreated areas are minimized. The untreated areas of the web other than the treated areas are thus prevented from suffering an adverse effect.

PRIOR ART DOCUMENT

Patent Document

Patent Document 1: Unexamined Japanese Patent Publication (Kohyo) No. 2004-512849

SUMMARY OF THE INVENTION

Problem to be Solved by the Invention

The manufacturing method disclosed in Patent Document 1 requires a plurality of applicators and dryers to be installed along the running path of the web in order to apply and dry the combustion inhibitor on the web more than one time during the running of the web. The method further requires that the applicators be operated in sync to coincide with their respective applied areas of the combustion-inhibitor on the web W. To this end, a manufacturing apparatus using the foregoing method has to have a large-scale configuration. For that reason, there is the problem that wrapping paper for low ignition propensity cigarettes cannot be provided at low cost.

It is an object of the present invention to provide a method and apparatus for manufacturing cigarette wrapping paper, which solve the above-mentioned problem, and stably and inexpensively manufacture unwrinkled high-quality wrapping paper for low ignition propensity cigarettes.

Means for Solving the Problem

In order to achieve the object, a method for manufacturing cigarette wrapping paper according to the invention, in which web to be formed into cigarette wrapping paper is conveyed, and liquid combustion inhibitor is applied onto the web during the conveyance of the web to form band layers of the combustion inhibitor extending in a width direction of the web at predetermined intervals in a conveying direction of the web, is characterized in that:

the web is applied with the combustion inhibitor and then dried (first step); water is applied onto an opposite side of the web with respect to the side on which the band layers have been formed through the first step (second step); and the web having gone through the second step is dried while pinched and stretched between drying and pressing rollers (third step).

More specifically, the second step is carried out by stretching the web having gone through the first step in the width direction with a roller, and then evenly applying a preset amount of water onto the entire surface of the opposite side of the web with respect to the side on which the band layers are formed. Preferably, inverted crown-shaped roller is utilized as the roller for stretching the web in the width direction. It is desirable that the web come into tight contact with the surface of the drying roller while stretched in the width direction by using, as the pressing roller, a heat-resistant rubber roller that is provided in the surface thereof with portions having different hardness, for example, soft portions helically extend from the middle of the roller to both ends thereof while positions of the soft portions are shifted in a circumferential direction of the rubber roller.

Preferably, two pressing roller are prepared, these pressing rollers are located at a web inlet and a web outlet of the drying roller arranged in a conveying path so as to face to the drying roller. It is also desirable that plural drying roller are prepared, these drying rollers are located in a multi-stage arrangement along the conveying path of the web.

The apparatus for manufacturing cigarette wrapping paper according to the invention, in which the web to be formed into cigarette wrapping paper is conveyed, and liquid combustion inhibitor is applied onto the web during the conveyance of the web to form band layers of the combustion inhibitor extending in a width direction of the web at predetermined intervals in a conveying direction of the web, is characterized by:

a combustion-inhibitor application mechanism for applying the combustion inhibitor onto the web to form the band layers;

a dryer for drying the combustion inhibitor applied onto the web by the combustion-inhibitor application mechanism;

a water applying mechanism located downstream of the dryer, for applying water onto the opposite side of the web with respect to the side on which the band layers are formed; and a drying mechanism including a drying roller and a pressing roller, for drying the web applied with water by the water applying mechanism while stretching the web pinched between the drying roller and the pressing roller.

The apparatus for manufacturing cigarette wrapping paper according to the invention is characterized by, in addition to the above configuration, a roll mechanism located upstream of the water applying mechanism, for stretching the web to be led toward the water applying mechanism in the width direction with a roller.

An inverted crown-shaped roller, for example, is suitable as the roller for stretching the web in the width direction. The water applying mechanism is configured to evenly apply a preset amount of water onto the entire surface of the opposite side of the web with respect to the side on which the band layers are formed.

Preferably, the drying mechanism includes, for example, the drying roller arranged in the conveying path of the web and two pressing rollers located at a web inlet and a web outlet of the drying roller so as to face to the drying roller. Preferably, plural drying roller are prepared, these drying rollers are located in a multi-stage arrangement along the conveying path of the web.

Technical Advantage of the Invention

With the method and apparatus for manufacturing cigarette wrapping paper according to the invention, unwrinkled high-quality cigarette wrapping paper can be manufactured without difficulty because the web is dried while pinched and stretched between the drying roller and the pressing rollers after the web having been applied with combustion inhibitor and subjected to drying treatment is applied with water on an opposite side with respect to a side of the web onto which the combustion inhibitor is applied. After the web is dried together with the combustion inhibitor applied to the web, the web is applied with water and dried while stretched in the width direction by using the drying roller and the pressing rollers, so that wrinkles having appeared in the web as a result of the application and drying of the combustion inhibitor can be effectively smoothed out.

The combustion-inhibitor application treatment and the drying treatment with respect to the web are required to be performed merely once. Accordingly, the configuration of the apparatus using the above manufacturing method can be also simplified. If there are wrinkles in the web where band layers are formed, the moisture content of the web is easily adjusted since the web undergoes the drying treatment while stretched after being applied with water. Consequently, there is an advantage that high-quality cigarette wrapping paper can be obtained at low cost.

BEST MODE FOR CARRYING OUT THE INVENTION

A method and apparatus for manufacturing cigarette wrapping paper according to one embodiment of the invention will be described below with reference to the attached drawings.

Figure 1:
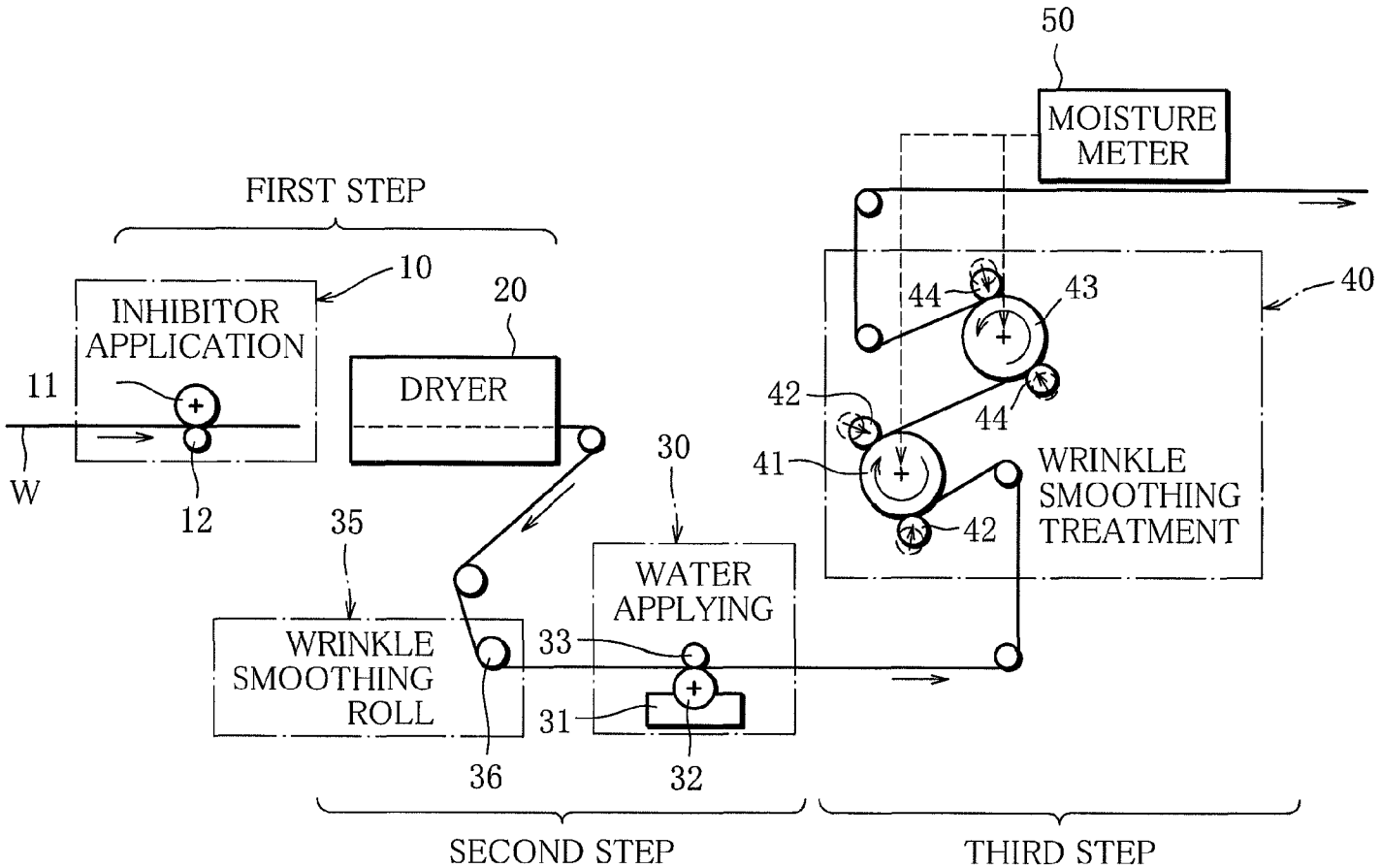
FIG. 1 is a schematic configuration view showing a main part of a manufacturing apparatus using a method for manufacturing cigarette wrapping paper according to one embodiment of the invention.

FIG. 1 is a schematic configuration view showing a main part of the manufacturing apparatus using the method according to the invention. The apparatus for manufacturing cigarette wrapping paper according to the invention is basically configured to reel out web W to be formed into wrapping paper 3 for cigarette 2 from a feed reel towards a take-up reel, not shown, along a predetermined running path and take up with the take-up reel the web W on which band layers 4 are formed. The web W on which the band layers 4 are formed is slit into wrapping papers 3 each having predetermined width, and then fed to a wrapping machine, not shown, for manufacturing cigarettes. In this way, low ignition propensity cigarettes 2 having the band layers 4 are manufactured.

The manufacturing apparatus according to the invention which manufactures the wrapping papers 3, that is, the web W on which the band layers 4 are formed, comprises an application unit (combustion-inhibitor application mechanism) 10 for applying liquid combustion inhibitor onto the web W, which is arranged in the running path of the web W on the upstream side of the running path as shown in FIG. 1, and a dryer 20 arranged in the running path of the web W to be located downstream from the application unit 10. The application unit 10 includes, for example, a gravure roller 11 and a pinch roller 12 that pinches the web W between the pinch roller 12 and the gravure roller 11. When the web W reeled out from the feed reel runs towards the take-up reel and passes through the application unit 10, the application unit 10 applies, for example, sodium alginate solution as the combustion inhibitor onto one side of the web W, or a back side of the wrapping paper 3, by using the gravure roller 11, and thus forms the band layers 4. The dryer 20 includes a drying chamber, for example, having a passage for the web W. The dryer 20 quickly dries the web W passing through the drying chamber with an infrared heater, for example, at a drying temperature in a range from 100° C. to 200° C., or preferably at 170° C. The application unit 10 and the dryer 20 achieve a first step that exhibits a basic function of forming the band layers 4 in the web W.

When the belt-like band layers 4 are formed in the web W at predetermined intervals in a running direction of the web W through the first step, it is unavoidable that wrinkles appear in treated areas of the web onto which the combustion inhibitor is applied, and also in untreated areas of the web W (areas in which the combustion inhibitor is not applied) depending upon difference in shrinkage percentage between the treated areas and the other areas. In the apparatus of the invention, a water applying mechanism 30 for applying water onto an opposite side of the web W (front side of the wrapping paper 3) from the side on which the band layers 4 are formed is located downstream of the dryer 20 in the running path of the web W. The water applying mechanism 30 has an application roller 32 partially immersed, for example, in a water tank 31, and a pinch roller 33 pinching the web W between the pinch roller 33 and the application roller 32. The water applying mechanism 30 applies a preset amount of water onto the entire surface of the opposite side of the web W with the application roller 32 when the web W passes through the water applying mechanism 30. Preferably, the amount of water applied onto the web W with the application roller 32 is, for example, in a range from about 1 g/m$^2$ to 10 g/m$^2$.

Figure 2:
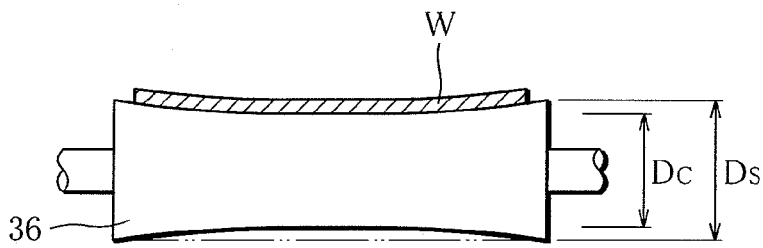
FIG. 2 is a view showing one example of an inverted crown-shaped roller.

According to this embodiment, a roll mechanism 35 is located upstream of the water applying mechanism 30 in order to evenly apply water onto the web W in which wrinkles have appeared as mentioned. The roll mechanism 35 includes a roller 36 as illustrated in FIG. 2, for example. The roller 35 is a so-called inverted crown-shaped roller having a circumferential face (roller face) curved so that the diameter of a central portion of the roller 36 is smaller than that of each end of the roller 36. The roll mechanism 35 including the roller 36 has a function to make the web W run along the circumferential face of the roller 36 while giving predetermined tension to the web W. The inverted crown-shaped roller 36 functions to stretch the web W in a width direction by using difference in circumferential velocity between an outer diameter Dc of the central portion and an outer diameter Ds of each end of the roller 36. As a result, the wrinkles that have appeared in the web are automatically smoothed to some degree.

Needless to say, it is also possible to use a flat expander, a helical roll or the like, instead of using the inverted crown-shaped roller 36, to stretch the web W in the width direction and automatically smooth the wrinkles of the web W to some degree.

The apparatus is adapted to stretch the wrinkles in the web W guided toward the water applying mechanism 30 by using the inverted crown-shaped roller 36 of the roll mechanism 35 as smooth as possible, and then to carry out a more even application of water onto the entire web W with the water applying mechanism 30. The water applying mechanism 30 provided with the roll mechanism 35 located upstream thereof carries out a second step that evenly applies the preset amount of water onto the web W as a pre-treatment for smoothing the wrinkles that have appeared in the web W where the band layers 4 are formed.

A drying mechanism 40 for drying the web W applied with water while stretching the web W to remove the wrinkles is located downstream of the water applying mechanism 30 in the running path of the web W. The drying mechanism 40 carries out a third step of the method according to the invention. The drying mechanism 40 basically includes a drum-type drying roller 41, and pressing rollers 42 facing to the drying roller 41 and pinch the web applied with water by the water applying mechanism 30 between the pressing rollers 42 and the drying roller 41. The pressing rollers 42 are located at a web inlet and a web outlet of the drying roller 41, respectively, and make the web W convey while the web W is in tight contact with a circumferential face of the drying roller 41 over a predetermined length in a circumferential direction of the drying roller 41.

According to the embodiment, the first drying roller 41 and a second drying roller 43 are successively arranged along the running path of the web W. Pressing rollers 44 are also located at inlet and outlet of the second drying roller 43 for the web W. In this embodiment, the two drying rollers 41 and 43 carry out the two-stage drying treatment so that the web W has predetermined moisture content. It is also obviously possible to install other drying rollers along the running path of the web W to perform three or more stage drying treatment.

Drying temperatures at which the web W is dried by the first and second drying rollers 41 and 43 are feedback-controlled according to the moisture content of the web W, which is measured, for example, by an infrared moisture meter located downstream of the drying mechanism 40. As a result of this control, the moisture content of the web W, on which the band layers 4 are formed, having undergone the drying treatment of the drying mechanism 40 is adjusted to enough moisture content to obtain a prescribed quality.

Figure 3:
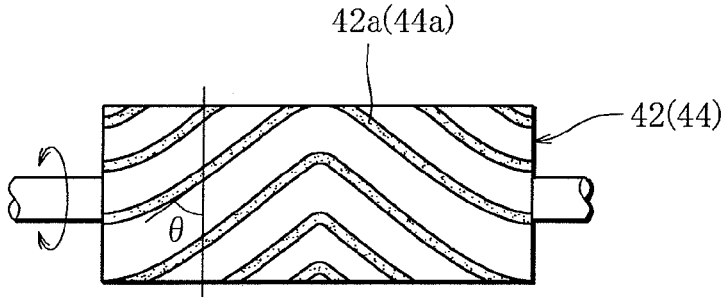
FIG. 3 is a view showing one example of a pressing roller.
Figure 4:
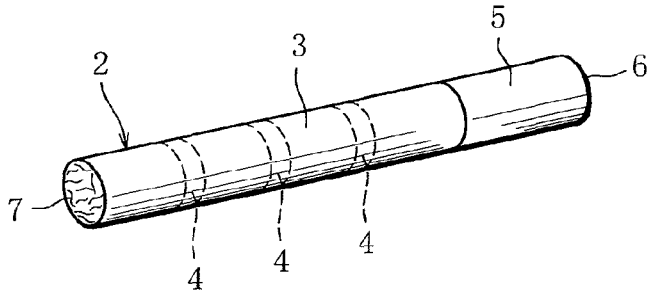
FIG. 4 is schematic view of a low ignition propensity cigarette.
Figure 5:
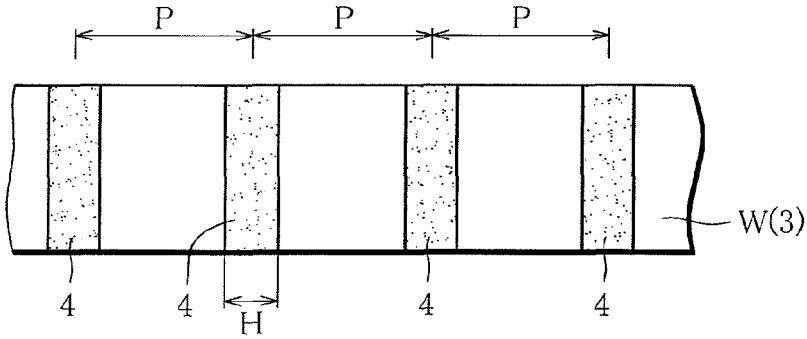
FIG. 5 is a view showing a part of web to be formed into wrapping paper.

The drying roller 41(43) and the pressing rollers 42 (44) of the drying mechanism 40 will be described below in more details. The drying roller 41 (43) includes a cylindrical drum whose outer circumferential face is formed as a smooth heating face, and has a function of heating the face of the drum at predetermined drying temperature (heating temperature at which the web W is heated) by energizing an induction coil housed inside the cylindrical drum. The pressing rollers 42 (44), especially the pressing roller 42 (44) located at the inlet of the drying roller 41 (43) for the web W, is made of a heat-resistant rubber roller that is provided in a column-shaped surface (outer circumferential face) thereof with portions having different hardness, for example, soft portions 42*a* and 44*a*, as shown in FIG. 3. The soft portions 42*a* and 44*a* extend helically from the middle of the roller toward both ends of the roller while their positions are shifted in a circumferential direction of the roller. There are pluralities of the soft portions 42*a* and 44*a*, these soft portions are arranged at predetermined pitches in the circumferential direction of the roller. The pressing rollers 42 (44) located at the outlet of the drying roller 41 (43) for the web W may be ordinary cylindrical rollers made of heat-resistant rubber.

The pressing rollers 42 (44) having the helical soft portions 42*a* (44*a*) are pressed against the circumferential face of the drying roller 41 (43) while applied with predetermined pressure. The pressing rollers 42 (44) function to deliver the web W that is guided to and pinched between the rollers 41 and 42 (43 and 44), stretching the web W in the width direction of the rollers 41 and 42 (43 and 44) by using the helical soft portions 42*a* (44*a*). The pressing roller 42 (44) pinches the web W between the pressing roller 42 (44) and the drying roller 41 (43) over the entire width of the web W, and is rotated while gradually stretching the web W in an axial direction of the rollers 42 (44) from the central portion to the ends thereof, to thereby smooth the wrinkles of the web W along the surface of the web W in the width direction.

The web W having been stretched by the rollers 41 and 42 (43 and 44) in the width direction is conveyed to the pressing rollers 42 (44) located at the outlet of the drying roller 41 (43) in tight contact with the outer circumferential face of the drying roller 41 (43) while the drying roller 41(43) is rotated. Meanwhile, the web W receives heat from the drying roller 41 (43) to be dried.

In other words, the web W led to the drying mechanism 40 is pinched between the drying roller 41 (43) and the pressing rollers 42 (44), and thus undergoes the drying treatment in a state where the wrinkles caused by forming the band layers 4 are smoothed out. In this way, the wrinkles are removed. The embodiment carries out the foregoing wrinkle removal treatment in two stages (multiple stages), so that the drying treatment is performed while the wrinkles are smoothed out without applying excessive load (tension) to the web W itself.

According to the above-described apparatus for manufacturing the web W on which the band layers 4 made of the combustion inhibitor are formed, the applying treatment of the liquid combustion inhibitor onto the web W needs to be performed only once. The application unit (combustion-inhibitor application mechanism) 10 can be therefore simply configured, as compared to the case where the combustion inhibitor is applied more than one time as disclosed in Unexamined Japanese Patent Publication (Kohyo) No. 2004-512849. Furthermore, since the web W on which the band layers 4 are formed by the application of the combustion inhibitor and then the drying treatment is uniformly (evenly) applied with water on the entire surface thereof to be moisturized, and is further subjected to the drying treatment while the wrinkles are smoothed out by the drying mechanism 40 with the above-described configuration, it is possible to carry out the so-called wrinkle removal treatment while adjusting the moisture content of the web W without difficulty.

More specifically, the web W is pinched between the heat-resistant rubber pressing rollers 42 (44) with the helical soft portions 42*a* (44*a*) and the drying roller 41 (43), and is brought into tight contact with the circumferential face (roller face) of the drying roller 41 (43) to stretch the wrinkles of the web W. In this state, as the web W is dried, the wrinkles of the web W can be effectively removed. It is therefore possible to easily manufacture the high-quality web W with the band layers 4 made of the combustion inhibitor, which has been unwrinkled and adjusted in moisture content.

When the web W manufactured as described is used to manufacture the low ignition propensity cigarettes 2, the moisture content of the web W (wrapping paper 3) can be properly maintained without difficulty. Accordingly, there is an advantage that the band layers 4 made of the combustion inhibitor do not adversely affect the flavor of the cigarettes 2. In the conventional art, when the band layers 4 made of the liquid combustion inhibitor are formed in the web W, for example, the moisture content of the web W (wrapping paper 3) may be changed by the drying treatment of the combustion inhibitor. Such a change of the moisture content becomes a factor that can change the flavor of the cigarettes 2, which is affected by the wrapping paper 3.

In this respect, according to the manufacturing method and apparatus of the invention, water is applied onto the entire surface of the web W in which the band layers 4 made of a proper amount of the combustion inhibitor are formed, and the web W is pinched between the drying roller 41 (43) and the pressing rollers 42 (44), thereby performing the drying treatment while smoothing the wrinkles of the web W and adjusting the moisture content of the web W. It is then possible to manufacture the unwrinkled high-quality web W (wrapping paper 3) that does not adversely affect the flavor of the cigarettes 2, and to provide this web W for the manufacture of the low ignition propensity cigarettes 2.

The invention is not limited to the above-described embodiment. For example, the water applying mechanism 30, which has the application roller 32 that is partially immersed in the water tank 31, and the pinch roller 33 that pinches the web W between the pinch roller 33 and the application roller 32, is used to apply water onto the entire surface of the web W. Instead, however, water may be applied onto one side of the web W by spray. The number of the helical soft portions 42*a* (44*a*) formed in the surface of the pressing rollers 42 (44) of the drying mechanism 40 and a tilt angle θ of the helical soft portions 42*a* (44*a*) with respect to a rotating direction of the pressing rollers 42 (44) may be beforehand determined according to the diameter and rotational velocity of the pressing rollers 42 (44), the degree of tension of the web W, etc. The invention may be modified in various ways without deviating from the gist thereof.

REFERENCE MARKS

2 cigarette
3 wrapping paper (web W)
4 band layers (combustion-inhibitor applied area)
10 application unit (combustion-inhibitor application mechanism)
20 dryer
30 water applying mechanism
35 roll mechanism (inverted crown-shaped roller)
40 drying mechanism
41, 43 drying roller
42, 44 pressing roller
42*a*, 44*a* helical soft portion
50 infrared moisture meter

The invention claimed is:

1. A method for manufacturing cigarette wrapping paper, in which a web to be formed into cigarette wrapping paper is conveyed, and liquid combustion inhibitor is applied onto the web during the conveyance of the web to form band layers of the combustion inhibitor extending in a width direction of the web at predetermined intervals in a conveying direction of the web, characterized by:

a first step of applying the web with the combustion inhibitor and then drying the web;

a second step of applying water onto an opposite side of the web to a side on which the band layers have been formed through the first step; and a third step of drying the web having gone through the second step while pinching and stretching the web between drying and pressing rollers.

2. The method for manufacturing cigarette wrapping paper according to claim 1, wherein the second step follows the first step and comprises stretching the web in the width direction with a roller, and then evenly appling a preset amount of water onto the entire surface of the opposite side of the web with respect to a side on which the band layers are formed.

3. The method for manufacturing cigarette wrapping paper according to claim 2, wherein an inverted crown-shaped roller is utilized as the roller for stretching the web in the width direction, said inverted crown-shaped roller having a circumferential roller face curved so that a diameter of a central portion of the roller is smaller than that of each end of the roller.

4. The method for manufacturing cigarette wrapping paper according to claim 1, wherein at least one of the pressing rollers is formed of a heat-resistant rubber roller that is provided in the surface thereof with a plurality of portions of different hardness, which extend helically from the middle of the roller to both ends thereof while positions of the portions are arranged in a circumferential direction of the roller, and the pressing roller functions to bring the web into tight contact with the surface of the drying roller while stretching the web in the width direction.

5. The method for manufacturing cigarette wrapping paper according to claim 1, wherein two pressing roller are prepared, these pressing rollers are located at a web inlet and a web outlet of the drying roller arranged in a conveying path of the web.

6. The method for manufacturing cigarette wrapping paper according to claim 1, wherein plural drying rollers are prepared, the drying rollers located in a multi-stage arrangement along a conveying path of the web.

7. An apparatus for manufacturing cigarette wrapping paper, in which web to be formed into cigarette wrapping paper is conveyed, and liquid combustion inhibitor is applied onto the web during the conveyance of the web to form band layers of the combustion inhibitor extending in a width direction of the web at predetermined intervals in a running direction of the web, characterized by:

a combustion-inhibitor application mechanism for applying the combustion inhibitor onto the web to form the band layers;

a dryer for drying the combustion inhibitor applied onto the web by the combustion-inhibitor application mechanism;

a water applying mechanism located downstream of the dryer, for applying water onto an opposite side of the web with respect to the side on which the band layers are formed; and a drying mechanism including a drying roller and a pressing roller, for drying the web applied with water by the water applying mechanism while stretching the web pinched between the drying roller and the pressing roller.

8. The apparatus for manufacturing cigarette wrapping paper according to claim 7, characterized by:

a roll mechanism located upstream of the water applying mechanism, for stretching the web to be led toward the water applying mechanism in the width direction thereof with a roller.

9. The apparatus for manufacturing cigarette wrapping paper according to claim 8, wherein the roller for stretching the web in the width direction is an inverted crown-shaped roller having a circumferential roller face curved so that a diameter of a central portion of the roller is smaller than that of each end of the roller.

10. The apparatus for manufacturing cigarette wrapping paper according to claim 7, wherein the water applying mechanism is configured to evenly apply a preset amount of water onto the entire surface of the opposite side of the web with respect to the side on which the band layers are formed.

11. The apparatus for manufacturing cigarette wrapping paper according to claim 7, wherein the pressing roller is formed of a heat-resistant rubber roller that is provided in the surface thereof with a plurality of portions of different hardness, which extend helically from the middle of the roller to both ends thereof while positions of the portions are arranged in a circumferential direction of the pressing roller, and the pressing roller functions to bring the web into tight contact with the surface of the drying roller while stretching the web in the width direction.

12. The apparatus for manufacturing cigarette wrapping paper according to claim 7, wherein the drying mechanism includes the drying roller arranged in a conveying path of the web and two pressing rollers located at a web inlet and a web outlet of the drying roller.

13. The apparatus for manufacturing cigarette wrapping paper according to claim 7, wherein plural drying rollers are prepared, the drying rollers located in a multi-stage arrangement along a conveying path of the web.

14. The apparatus for manufacturing cigarette wrapping paper according to claim 8, wherein the water applying mechanism is configured to evenly apply a preset amount of water onto the entire surface of the opposite side of the web with respect to the side on which the band layers are formed.

15. The apparatus for manufacturing cigarette wrapping paper according to claim 8, wherein the pressing roller is formed of a heat-resistant rubber roller that is provided in the surface thereof with a plurality of portions of different hardness, which extend helically from the middle of the roller to both ends thereof while positions of the portions are arranged in a circumferential direction of the pressing roller, and the pressing roller functions to bring the web into tight contact with the surface of the drying roller while stretching the web in the width direction.

16. The apparatus for manufacturing cigarette wrapping paper according to claim 8, wherein the drying mechanism includes the drying roller arranged in a conveying path of the web and two pressing rollers located at a web inlet and a web outlet of the drying roller.

17. The apparatus for manufacturing cigarette wrapping paper according to claim 8, wherein plural drying rollers are prepared, the drying rollers located in a multi-stage arrangement along a conveying path of the web.

* * * * *